US006513657B2

(12) United States Patent
Sheehan, Jr.

(10) Patent No.: US 6,513,657 B2
(45) Date of Patent: Feb. 4, 2003

(54) PRODUCT PACKAGING WITH HANDLE-FORMING TEARABLE TAPE SYSTEM

(75) Inventor: Richard L. Sheehan, Jr., Stillwater, MN (US)

(73) Assignee: 3M Innovative Properties Co., St. Paul, MN (US)

( * ) Notice: Subject to any disclaimer, the term of this patent is extended or adjusted under 35 U.S.C. 154(b) by 0 days.

(21) Appl. No.: 09/843,004

(22) Filed: Apr. 26, 2001

(65) Prior Publication Data

US 2002/0157980 A1 Oct. 31, 2002

(51) Int. Cl.[7] ..... B65D 65/36

(52) U.S. Cl. ..... 206/497; 53/412; 53/413; 206/428; 206/432; 229/117.13; 229/235; 229/239

(58) Field of Search ..... 53/412, 413, 442; 206/141, 161, 162, 428, 433, 432, 497; 294/141, 149; 229/117.13, 235, 240, 241, 242, 239; 383/6, 10, 17, 22

(56) References Cited

U.S. PATENT DOCUMENTS

| | | | | |
|---|---|---|---|---|
| 2,315,116 A | | 3/1943 | Flizikowski | |
| 2,517,801 A | | 8/1950 | Roush | |
| 2,895,865 A | | 7/1959 | Humpher | |
| 2,982,400 A | * | 5/1961 | Andre | 206/428 |
| 3,089,634 A | | 5/1963 | Heise et al. | |
| 3,504,844 A | | 4/1970 | Stark et al. | |
| 3,810,813 A | | 5/1974 | Ellis | |
| 3,873,018 A | | 3/1975 | Donnay | |
| 3,980,224 A | | 9/1976 | Yasuda | |
| 4,700,528 A | | 10/1987 | Bernard | |
| 4,779,731 A | * | 10/1988 | Fujio | 206/497 |
| 4,781,296 A | | 11/1988 | Morris et al. | |
| 4,830,895 A | | 5/1989 | Bernard | |
| 4,905,888 A | | 3/1990 | Suoss et al. | |
| 4,946,723 A | | 8/1990 | Paules et al. | |
| 5,035,328 A | | 7/1991 | Kim | |
| 5,054,618 A | | 10/1991 | Kim | |
| 5,079,066 A | | 1/1992 | Leseman et al. | |
| 5,080,281 A | | 1/1992 | Seabold | |
| 5,080,957 A | | 1/1992 | Leseman et al. | |
| 5,093,187 A | | 3/1992 | Engelmann et al. | |
| 5,186,542 A | | 2/1993 | Seabold | |
| 5,203,634 A | | 4/1993 | Kim | |
| 5,213,258 A | | 5/1993 | Kim | |
| RE34,323 E | * | 7/1993 | Heikkinen | 229/87.04 |
| 5,271,553 A | | 12/1993 | Kim | |
| 5,381,891 A | * | 1/1995 | Harris | 206/428 |
| 5,464,285 A | * | 11/1995 | Anderson | 383/10 |
| 5,662,420 A | | 9/1997 | Sinda | |
| 2001/0000480 A1 | | 4/2001 | Sheehan et al. | |

FOREIGN PATENT DOCUMENTS

| | | |
|---|---|---|
| AU | 72930/91 | 9/1991 |
| DE | 44 02 444 | 8/1995 |
| EP | 0 447 209 B1 | 7/1993 |
| EP | 0755 868 B1 | 1/1997 |
| FR | 2 687 379 | 8/1993 |
| WO | WO 95/07848 | 3/1995 |
| WO | WO 98/56581 | 12/1998 |
| WO | WO 99/61344 | 12/1999 |

* cited by examiner

*Primary Examiner*—Jim Foster
(74) *Attorney, Agent, or Firm*—Melissa E. Buss

(57) ABSTRACT

A packaged good article including an article, a packaging material and a tearable tape system. The packaging material is formed about the article. The tearable tape system is secured to the packaging material and includes at least a first section and a second section. The tearable tape system can assume a number of forms. Regardless, the first section is tearable relative to the second section. With this configuration, the tearable tape system is configured to be tearable from an initial, unopened state and an opened state. In the initial, unopened state, an area of the packaging material otherwise contacting the tearable tape system is intact. Conversely, in the opened state, the tearable tape system tears an opening through the packaging material, with the second section remaining secured to the packaging material. The second section, in combination with the packaging material, provides a handle for carrying the packaged good article in the opened state. In this regard, the handle is configured to have sufficient tensile strength to support a weight of the article. Thus, the tearable tape system renders the packaging material easy to open, and provides a convenient handle following opening.

48 Claims, 6 Drawing Sheets

PRODUCT PACKAGING WITH HANDLE-FORMING TEARABLE TAPE SYSTEM

BACKGROUND OF THE INVENTION

The present invention relates to product packaging and tearable tape systems. More particularly, it relates to product packaging incorporating a tearable tape system that renders the packaging easy to open, and provides a handle for convenient transporting of the packaged product following opening thereof.

A multitude of products are packaged and sold to consumers in group form. For example, single serving containers (e.g., cans or bottles) are commonly packaged in groups of six or twelve for sale to consumers. Following purchase, the consumer removes a desired number of individual products from the packaging and uses or consumes the same. One highly desirable advantage of grouped product packaging is that the products are compactly and relatively rigidly maintained relative to one another. This feature allows the consumer to easily transport a number of individual products and to store the unused packaged good article in locations and orientations that would otherwise be unavailable were the products not associated with one another by the packaging. For example, plastic bottles are widely used to contain a number of different beverages, such as water. Due to their generally cylindrical nature, it is difficult to store an individual bottle on its side (such as in a refrigerator), as the bottle will undesirably roll. Even further, a second bottle cannot be stacked on top of a bottle otherwise lying on its side, again because the bottles will roll relative to one another. However, by compactly packaging a number of individual bottles within a shrink-wrapped plastic (e.g., a six-pack), the cylindrical bottles can effectively be stored on their side. In other words, the packaging material maintains the bottles relative to one another such that the entire packaged good article can be placed on its side. Similar beneficial results are evidenced by other packaging schemes, such as a paperboard box formed about a grouping of products (e.g., beverage cans, etc.). In short, tightly packaging a grouping of individual containers or products is widely employed and highly desired by consumers.

As suggested by the above discussion, a number of different packaging materials are available for compactly packaging groupings of individual products, including thin-walled plastics and paperboard. To this end, a preferred feature of the resulting packaging is that the packaging itself should be easy to open. One relatively straightforward opening technique is to form a series of perforations through the packaging material that allows the user to simply tear the package open. Alternatively, tearable tape strips have been developed for plastic-based envelopes that readily tear, and thus open, the packaging material. While viable as an opening device, these envelopes and other packaging applications fail to recognize, let alone address, a resulting complication. Namely, once opened, it is exceedingly difficult to conveniently transport the products otherwise remaining within the packaging.

Prior to opening, the package can be transported by a consumer who simply grasps or otherwise holds one side or end of the package. Alternatively, a separate handle or harness can be fastened to the packaging material. Unfortunately, a separately formed and subsequently attached handle or harness entails additional package processing and costs, and may be cost prohibitive on a mass production basis. To overcome this concern, U.S. Pat. No. 4,830,895 ("the '895 patent") describes implementation of a tape strip that serves as a handle prior to opening. The '895 patent, assigned to the same assignee of the present invention and the teachings of which are incorporated herein by reference, is unconcerned with how the packaging is opened and does not suggest use of a tearable tape strip. Even if such a strip were employed, however, the tearing action would likely remove the strip entirely, such that the handle feature would no longer be available. Conversely, other tearable tape systems utilized with plastic mailing envelopes are configured only to facilitate opening of the packaging material, with no concern for subsequent handling issues.

In some instances, the particular packaging material will tear uncontrollably, effectively destroying the integrity of the package. Alternatively, even where the tear is relatively "clean", the packaging material is weakened along the tear. Subsequently, the user may experience great difficulties when attempting to lift and transport the package. That is to say, grasping the packaging material in the region of the tear opening and then lifting will likely cause the tear to further propagate, thereby destroying the product-containing attribute of the packaging material. Notably, the same result will likely occur even with a separately formed and attached harness. Even further, and with specific reference to plastic-based shrink-wrapped packaging, once the packaging material has been torn and at least one product removed therefrom, the plastic material will no longer be "stretched" about all of the remaining products such that they can now more easily become displaced within the package. This undesirable occurrence renders replacement of the removed product exceedingly difficult, and accelerates package deterioration in that a center of gravity of the contained products will shift, leading to tear propagation when a lifting force is placed on the package.

Consumers continue to demand packaging schemes that contain groupings of individual products. While packaging designs have evolved to provide an easy open feature for plastic envelopes, these applications have not been considered for multiple product packages. Further, the handling complications found with multiple product packages following opening remain unresolved. Therefore, a need exists for multiple product packaging that is easy to open and provides a handle for transporting the package following opening thereof.

SUMMARY OF THE INVENTION

One aspect of the present invention relates to a packaged good article including an article, a packaging material and a tearable tape system. The packaging material is formed about the article. The tearable tape system is secured to the packaging material and includes at least a first section and a second section. The tearable tape system can assume a number of forms. Regardless, the first section is tearable relative to the second section. With this configuration, the tearable tape system is configured to be tearable from an initial, unopened state and an opened state. In the initial, unopened state, an area of the packaging material otherwise contacting the tearable tape system is intact. In one preferred embodiment, the tearable tape system and the packaging material are, in combination, configured to provide a handle in the unopened state. Regardless, in the opened state, the tearable tape system tears an opening through the packaging material, with the second section remaining secured to the packaging material. The second section, in combination with the packaging material, provides a handle for carrying the packaged good article in the opened state. In this regard, the handle, as defined by a combination of the second section and the packaging material is configured to have sufficient strength to support a weight of the article when lifted by the handle. Thus, the tearable tape system renders the packaging material easy to open, and provides, preferably continues to provide, a convenient handle following opening.

Another aspect of the present invention relates to a method of packaging an article comprising a plurality of products in a packaging material. The method includes providing a packaging material. A tearable tape system including a first section tearable relative to a second section is selected. More particularly, the tearable tape system is selected in combination with the packaging material to provide the second section with sufficient strength to support a weight of the article. The tearable tape system is secured to the packaging material that, in turn, is formed about the article. Upon final assembly, the tearable tape system is transitionable to an opened state in which the tearable tape system tears an opening through the packaging material for accessing the article, the second section of the tearable tape system remaining secured to the packaging material in the opened state. The second section, in combination with the packaging material, is configured to provide a handle for carrying the article in the opened state. In one preferred embodiment, the tearable tape system, in combination with the packaging material, provides a handle prior to opening, such that the second section, in combination with the packaging material, essentially continues to provide a handle in the opened state. In another preferred embodiment, the packaging material is a plastic film shrink wrapped onto the article.

Yet another aspect of the present invention relates to a method of using a packaged good article. The packaged good article includes a packaging material formed about an article, along with a tearable tape system secured to the packaging material. The tearable tape system includes at least a first and a second section, with the first section being tearable relative to the second section. With this in mind, the method includes tearing the tearable tape system to form an opening through the packaging material. In this regard, the second section remains secured to the packaging material upon tearing of the tearable tape system. The packaged good article is lifted following tearing of the tearable tape system by grasping the second section. In this regard, the second section, in combination with the packaging material, is configured to support a weight of the article. In one preferred embodiment, the tearable tape system reinforces the opening through the packaging material, thereby allowing the user to easily remove and/or return one or more products from an enclosed region defined by the packaging material.

DESCRIPTION OF THE PREFERRED EMBODIMENTS

Figure 1:
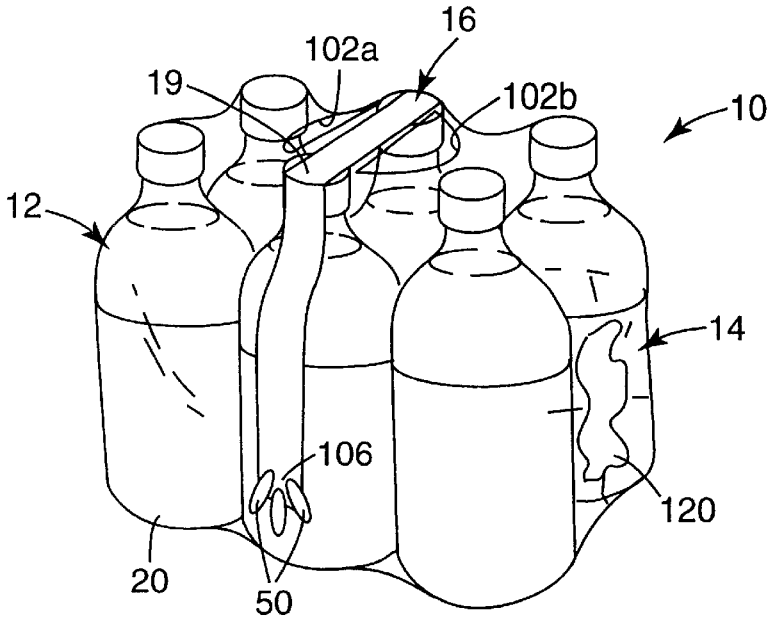
FIG. 1 is a perspective view of one preferred packaged good article in accordance with the present invention in an initial, unopened state.
Figure 2:
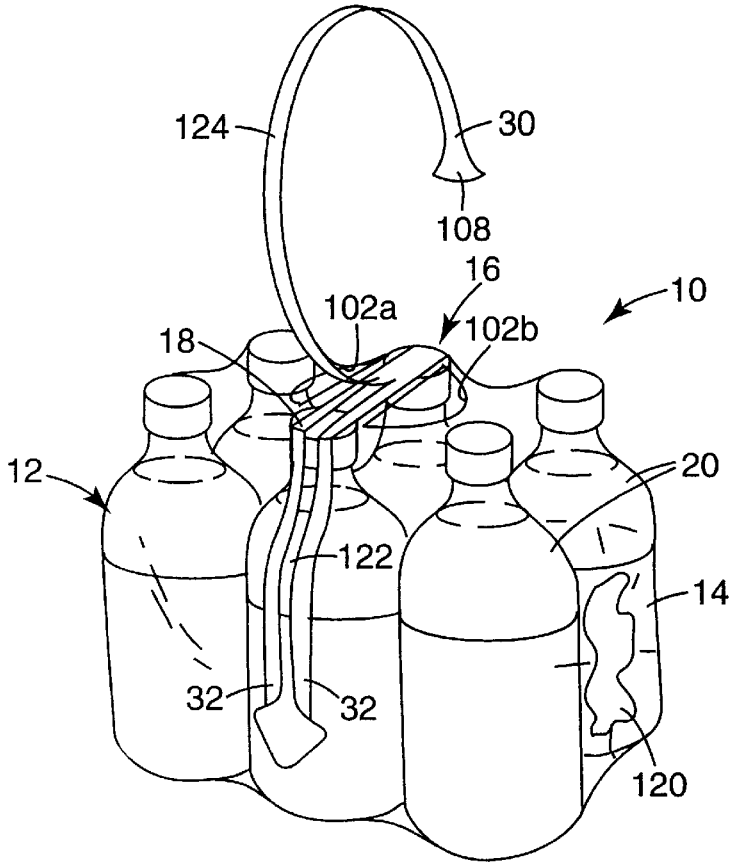
FIG. 2 is a perspective view of the packaged good article of FIG. 1 in a partially opened state.

One preferred embodiment of a packaged good article 10 in accordance with the present invention is illustrated in FIGS. 1 and 2. The packaged good article 10 includes an article 12, packaging material 14, and a tearable tape system 16. Details on the various components are provided below. In general terms, however, the tearable tape system 16 is secured to the packaging material 14 that, in turn, is formed about the article 12. The tearable tape system 16 allows a user (not shown) to readily transition the packaged good article 10 from an initial, unopened state (FIG. 1) to an opened state (FIG. 2). As a point of reference, FIG. 2 depicts a transition of the packaged good article 10 from the unopened state, such that the packaged good article 10 in FIG. 2 is more accurately described as being "partially opened". In the opened state, the tearable tape system 16, in combination with the packaging material 14, provides at least one handle (shown generally at 18 in FIG. 2) by which the user can conveniently lift and transport the packaged good article 10. With respect to the one preferred embodiment of FIG. 1, the tearable tape system 16, in combination with the packaging material 14, is further configured to provide a handle (shown generally at 19 in FIG. 1) in the unopened state. With this one preferred embodiment, then, the tearable tape system 16 is more accurately described as, in combination with the packaging material 14, continuing to provide a handle (such as the handle 18) in the opened state.

The article 12 can assume a wide variety of forms, and in one preferred embodiment is comprised of a plurality of individual products 20. For example, FIGS. 1 and 2 illustrate six of the products 20, each of which is a bottle containing a beverage such as water. It will be understood that this is but one example of an acceptable article 12. For example, the products 20 can contain a wide variety of other consumable (e.g., soda pop) or non-consumable (e.g., motor oil) liquids, or consumable or non-consumable semi-liquids, solids, combinations thereof, etc. Similarly, the number of the products 20 can be more or less than six. Further, the products 20 can include something other than bottles, and instead can be cylindrical or irregularly shaped cans, glass containers, boxed items (e.g., juice boxes), other forms of relatively rigid containers, etc. Also, each of the products 20 can be identical or different. Basically, any product or products that a consumer might desire to purchase in a bulk quantity (e.g., two or more) or grouped to one another can be used as the article 12.

The packaging material 14 can also assume a wide variety of forms. In one preferred embodiment, the packaging material 14 is a heat-shrinkable, plastic film such as polyethylene. A wide variety of plastic films useful for packaging applications is also available including linear low-density polyethylene (LLDPE), low-density polyethylene (LDPE), Surlyn® ionomer film (available from E. I duPont de Nemours and Company of Wilmington, Del.), Kraton™/polypropylene blends (available from Kraton Polymers of Houston, Tex.), copolymers of propylene and ethylene, blends of propylene and polyethylene, nylon, polyvinyl chloride, polyvinyldene chloride, cellophane, cellulose acetate, biaxially oriented polypropylene (BOPP), to name but a few. Further, the selected film for the packaging material 14 can have either a single layer or a multi-layer construction. With a multiple layer film, the layers can be identical or different. For example, in one embodiment, the packaging material 14 includes a first layer of polyethylene and a second layer of polypropylene. Alternatively, the packaging material 14 can include materials other than plastic, or may be something other than plastic. To this end, and as described in greater detail below, the packaging material 14 can be, or can include, paperboard.

Regardless of the exact form of the packaging material 14, the tearable tape system 16 is configured to render the packaging material 14 easy to open, and includes at least a first section 30 and a second section 32. As a point of reference, the tearable tape system 16 of FIGS. 1 and 2 is illustrated as providing two of the second sections 32 each of which, in combination with the packaging material 14, can serve as the handle 18. However, as described below, in a preferred embodiment, both of the second sections 32, in combination with the packaging material 14, serves as the handle 18. Regardless, the first section 30 is tearable relative to the second section 32 such that the tearable tape system 16 is configured to tear, preferably controllably tear, an opening through the packaging material 14 upon tearing of the tearable tape system 16. The phrase "controllably tear" is in reference to a substantially uniform or clean tear through the packaging material 14, with the tear in the packaging material 14 corresponding in length and width with the tear in the tearable tape system 16. The edges of tear in the packaging material 14 are not relatively jagged or otherwise relatively stretched.

Figure 3A:
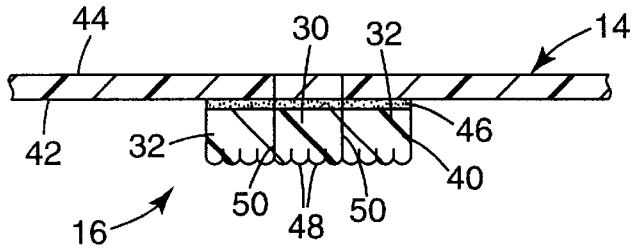
FIG. 3A is a cross-sectional view of a portion of the packaged good article of FIG. 1, including packaging material and a tearable tape system.

With the above parameters in mind, the tearable tape system 16 can assume a wide variety of forms. One preferred embodiment of the tearable tape system 16 in conjunction with a portion of the packaging material 14 is shown by the cross-sectional view of FIG. 3A. In the embodiment of FIG. 3A, the tearable tape system 16 includes a tearable tape strip 40. The tearable tape strip 40 can be a reinforced strapping tape, tearable filament reinforced tape, tensilized polypropylene, or other oriented or non-oriented film that tears preferentially in a longitudinal direction (i.e., along a length of the tearable tape system 16 as illustrated in FIG. 2). In a most preferred embodiment, the tearable tape strip 40 is a reinforced strapping tape having a width of at least 8 mm, and available, for example, under the tradename 864 Scotch® Reinforced Strapping Tape from Minnesota Mining and Manufacturing Company (3M). The tearable tape strip 40 is secured to a surface of the packaging material 14. With reference to the orientation of FIG. 3A, the packaging material 14 generally defines an interior surface 42 and an exterior surface 44 (with the exterior surface 44 being "exposed" in FIGS. 1 and 2). With this orientation in mind, the tearable tape strip 40 is preferably secured to the interior surface 42, such as with an adhesive 46 (a thickness of which is exaggerated in FIG. 3A for purposes of illustration). The adhesive 46 can assume a wide variety of forms, but is preferably a pressure-sensitive adhesive known in the art.

With the one embodiment illustrated in FIG. 3A, the tearable tape strip 40 is defined by a plurality of longitudinal ribs 48. Alternatively, and as is known in the art, the ribs 48 are instead elongated strands of material applied to a tape. Even further, other known tearable tape strip constructions are also available. The ribs 48 constrain tears in the tearable tape strip 40 at a leading end thereof to control the direction of initial tear. In this regard, and in a preferred embodiment, nicks 50 (also shown in FIG. 1) are formed through the tearable tape strip 40 to define a location(s) of tear. With respect to the one preferred embodiment of FIG. 3A, two of the nicks 50 are provided, such that the tearable tape strip 40 defines the first section 30 and the second sections 32. As such, the tearable tape strip 40 is "internally tearable", whereby the first section 30 is tearable relative to the second sections 32. Alternatively, only a single one of the nicks 50 may be formed such that the tearable tape strip 40 defines only one of the second sections 32. Even further, a multiple nick 50 construction is also available. Regardless, during a tearing operation, the first section 30 tears an opening through the packaging material 14, whereas the second section(s) 32 remains secured thereto.

Figure 3B:
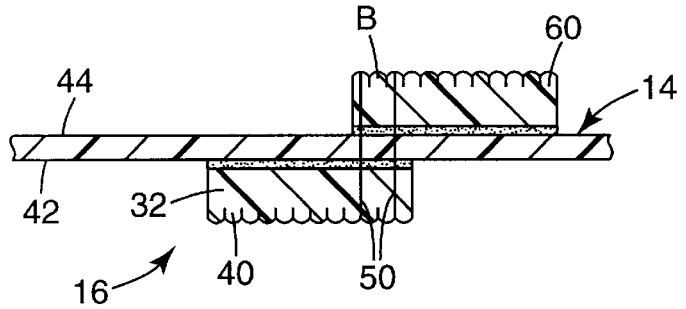
FIG. 3B is a cross-sectional view of a portion of an alternative embodiment packaged good article.

In the one preferred embodiment, the tearable tape system 16 is comprised of a single one of the tearable tape strip 40. Alternatively, and with reference to FIG. 3B, a second tearable tape strip 60 can be secured to the packaging material 14 substantially opposite the tearable tape strip 40 (i.e., on the exterior surface 44). Preferably, the tearable tape strips 40, 60 are aligned. Alternatively, however, the tearable tapes strips 40, 60 can be offset from one another, as shown in FIG. 3B. More particularly, the tearable tapes strips 40, 60 are both internally tearable, and each defines a width. At least a portion of the width of the tearable tape strip 40 overlaps at least a portion of the width of the second tearable tape strip 60 along the entire length of an area to be torn. The nicks 50 are preferably formed through both of the tearable tape strips 40, 60 and the packaging material 14. With this construction, a single band of material (identified as "B" in FIG. 3B) can simultaneously be internally torn from both of the tearable tape strips 40, 60. Alternatively, a cover tape, such as 373 Scotch® High-Performance Box Sealing Tape (available from 3M), can replace the second tearable tape strip 60.

Figure 3C:
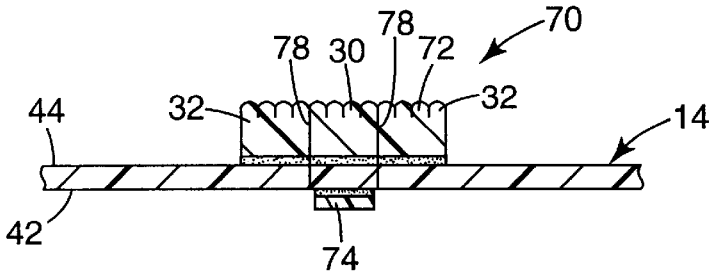
FIG. 3C is a cross-sectional view of a portion of another alternative embodiment packaged good article.

Another alternative embodiment of a tearable tape system 70 is illustrated in FIG. 3C. In particular, the tearable tape system 70 includes a tearable tape strip 72 and a narrow-width tear strip 74. The tearable tape strip 72 is similar to that previously described and is secured to the exterior surface 44 of the packaging material 14, such as with an adhesive 76. The narrow width tear strip 74 is secured to the interior surface 42 of the packaging material 14 opposite the tearable tape strip 72. The narrow-width tear strip 74 is of a type known in the art, for example, sold under the tradename Scotch® 8626 Tear Tape from 3M. Other types of narrow-width tear strips can alternatively be employed, such as tensilized polypropylene, reinforced strapping tape, or filament reinforced tape. During use, an outward pulling force is imparted onto the narrow-width tear strip 74 that in turn causes the tearable tape strip 72 to internally tear. In this regard, nicks 78, as previously described, can be formed in the tearable tape strip 72 to facilitate this tearing action. With this configuration, then, the narrow-width tear strip 74 and a central portion of the tearable tape strip 72 define the first section 30 of the tearable tape system 70 that are removed from the packaging material 14 during a tearing operation. In addition, the tearable tape strip 72 forms the second sections 32 that otherwise remain secured to the packaging material 14 following the tearing operation.

Figure 3D:
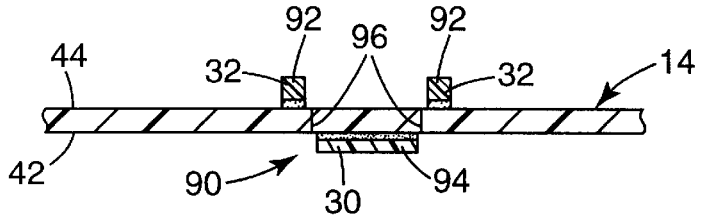
FIG. 3D is a cross-sectional view of a portion of another alternative embodiment packaged good article.

Yet another alternative tearable tape system 90 is illustrated in conjunction with the packaging material 14 in FIG. 3D. The tearable tape system 90 includes opposing guide strips 92 and a narrow-width tear strip 94. The opposing guide strips 92 are secured to the exterior surface 44 of the packaging material 14; whereas the narrow-width tear strip 94 is secured to the interior surface 42. As shown in FIG. 3D, the narrow-width tear strip 94 is approximately centered between the opposing guide strips 92. Finally, nicks 96, as previously described, are preferably formed through the packaging material 14 inside of the guide strips 92, respectively.

The opposing guide strips 92 are formed of a relatively non-tearable plastic material, such as tensilized polypropylene and constrain tearing of the packaging material 14. The narrow-width tear strip 94 is similar to that previously described with respect to the embodiment of FIG. 3C. With this configuration, the narrow-width tear strip 94 comprises the first section 30 of the tearable tape system 90, whereas the opposing guide strips 92 serve as the second sections 32.

During a tearing operation, the narrow width tear strip 94 is pulled outwardly, initially in the region of the nicks 96, causing the packaging material 14 to tear. The opposing guide strips 92, in turn, constrain the tear to an area between the guide strips 92. Following the tearing operation, the narrow width tear strip 94 is removed from the packaging material 14, whereas the opposing guide strips 92 remain secured thereto (e.g., form the second sections 32 in FIGS. 1 and 2). Thus, the opposing guide strips 92 define longitudinally confined tear lines.

Returning to FIGS. 1 and 2, regardless of its exact form, the tearable tape system 16 serves to facilitate easy opening of the packaging material 14, as well as, in combination with the packaging material 14, providing the handle 18 (via the second section(s) 32) following an opening procedure (i.e., FIG. 2). Once again, and in accordance with a most preferred embodiment, the tearable tape system 16 in combination with the packaging material 14, is configured to provide the handle 19 in the unopened state (FIG. 1). Thus, the tearable system 16, in combination with the packaging material 14, effectively provides a handle in both the unopened and opened states. In this regard, the handle 18, and thus the tearable tape system 16 in combination with the packaging material 14, is configured to have sufficient strength to support a weight of the article 12 such that the handle 18 will not fail when the packaged good article 10 is lifted via the handle 18. That is to say, the handle 18, otherwise formed by a portion of the tearable tape system 16 and the packaging material 14, will not break, tear, or otherwise grossly stretch during a lifting operation. This surprising inventive feature is not available with prior art tearable tape strip applied to packaging envelopes in that a handle was unnecessary or not contemplated, and the mailing envelopes inherently contained a lightweight article (e.g., paper) so that a strength of any remaining tape material was of no importance. In contrast, a construction and length of the tearable tape system 16 of the present invention in combination with the packaging material 14 is selected to adequately support a weight of the article 12.

Figure 4:
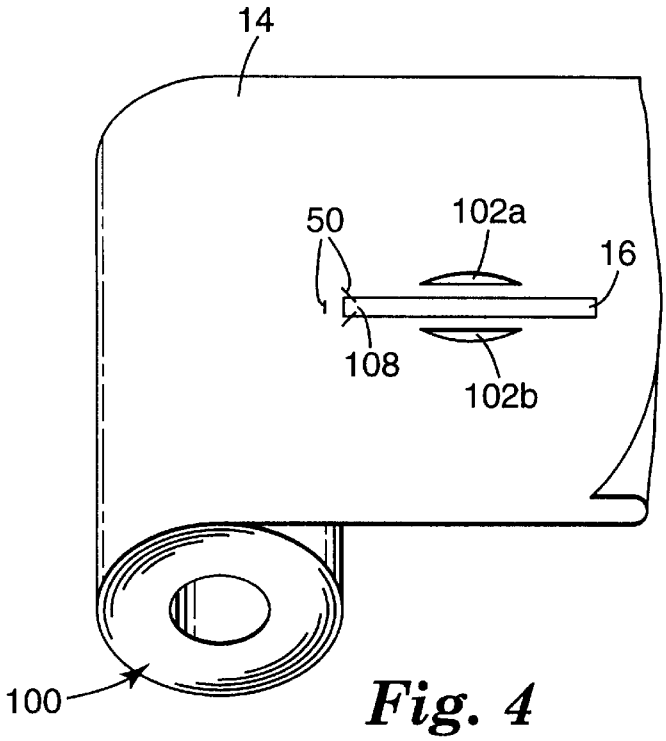
FIGS. 4 and 5 illustrate a method of manufacturing the packaged good article of FIG. 1 in accordance with the present invention.

As previously described, in the preferred embodiment of FIGS. 1 and 2, the packaging material 14 is a shrink-wrapable plastic. With this in mind, one preferred method of manufacture in accordance with the present invention includes providing a supply roll 100 of the packaging material 14 in the form of a heat shrinkable plastic film as shown in FIG. 4. An appropriately sized section of the tearable tape system 16 is then applied to the packaging material 14. In this regard, FIG. 4 illustrates the tearable tape system 16 as extending along a machine direction of the packaging material 14. Alternatively, however, the tearable tape system 16 can be positioned to extend perpendicular to (e.g., rotated 90° from the orientation illustrated in FIG. 4) the machine direction (e.g., "cross-web" direction), or diagonally relative to the machine direction. Slits 102*a* and 102*b* are then cut through the packaging material 14 adjacent opposing sides of the tearable tape system 16. While two of the slits 102*a,* 102*b* are illustrated in FIG. 4, any other number, either greater or lesser, can alternatively be provided, or the slits 102*a,* 102*b* can be omitted entirely. Finally, in accordance with one preferred embodiment, the nicks 50 are formed through the packaging material 14 and the tearable tape system 16 at an end 106 thereof. In an alternative embodiment, a second set of the nicks 50 are formed at an opposing end of the tearable tape system 16. As described in greater detail below, the nicks 50 define a tab 108 in the tearable tape system 16 that allows a user (not shown) to initiate a tear action and, depending upon the particular form of the tearable tape system 16 (e.g., incorporating a tearable tape strip), define tear line(s) along the tearable tape system 16. With this in mind, the tab-forming nicks 50 can be formed within the tearable tape system 16 away from either end thereof, so long as the integrity of the second sections 32 (FIG. 2) is substantially maintained.

Figure 5:
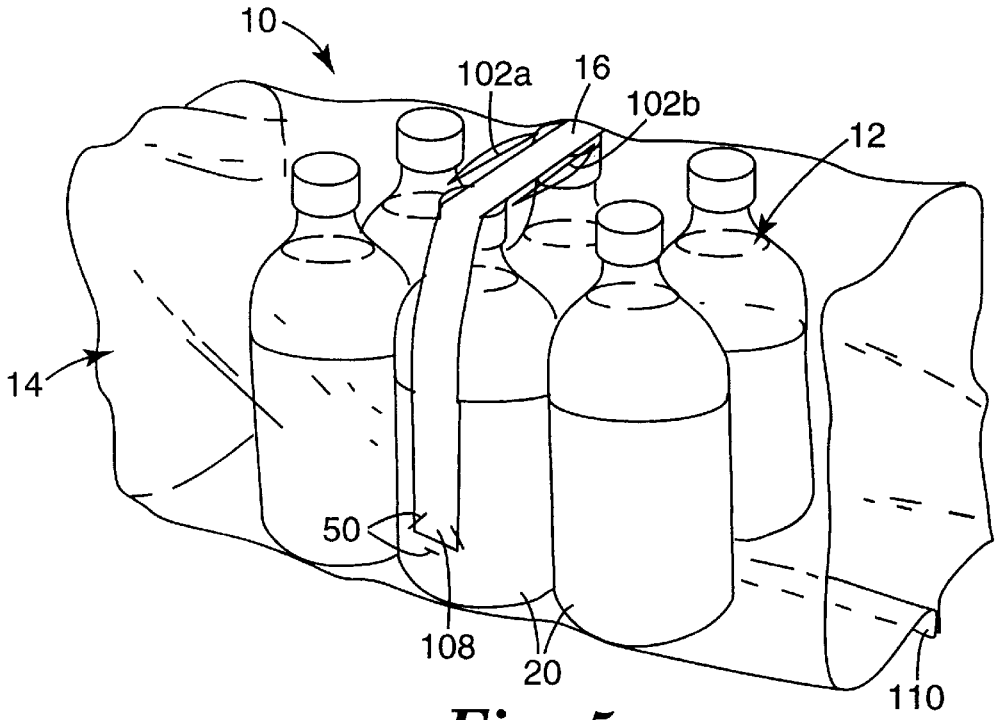

An appropriately sized section of the packaging material 14 is severed from a remainder of the supply roll 100 and then wrapped about the article 12 as shown in FIG. 5. Opposing sides of the packaging material 14 are then sealed at 110. Alternatively, the packaging material 14 can be wrapped and sealed about the article 12 prior to severing from a reminder of the supply roll 100 (FIG. 4). Regardless, the packaging material 14 is preferably positioned relative to the article 12 such that the tearable tape system 16 is substantially centered relative to the article 12. Further, a length of the tearable tape system 16 preferably bears a known relationship to individual ones of the product 20 otherwise comprising the article 12. More particularly, and as described in greater detail below, tearing of the tearable tape system 16 generates an opening through which one or more of the products 20 can be removed from the packaging material 14. As such, the tearable tape system 16 preferably has a length at least slightly greater than the smallest dimension of each of the plurality of products 20.

The packaged good article 10 is then passed through a heat tunnel, (not shown), causing the packaging material 14 to shrink tightly about the article 12. For example, where the packaging material 14 is a polyethylene material, heat shrinking of the packaging material may be done in approximately six seconds at 250° C., such as in a heat shrinking, forced air oven. Alternatively, the heat shrinking process can be carried out at other temperatures and/or times. With this preferred heat shrink technique, the packaging material 14 substantially conforms to a shape of the article 12, and prevents undesirable shifting or movement of the products 20 during shipping and handling. Further, as shown in FIG. 1, following heat shrinking, the slits 102*a,* 102*b,* expand (relative to a size illustrated in FIG. 5). With this one preferred embodiment, then, a user (not shown) can more easily transport the packaged good article 10 in the unopened state by simply extending his/her fingers and hand through one of the slits 102*a,* below the tearable tape system 16 and then outwardly through the other slit 102*b*. Alternatively, where handling of the packaged good article 10 in the unopened state of FIG. 1 is of less concern, the slits 102*a,* 102*b* can be omitted and thus do not form necessary parts of the present invention. For example, a user can manually puncture the packaging material 14 to effectively form the slits 102*a,* 102*b.*

It will be understood that heat-shrinking process described above is but one acceptable manufacturing technique. That is to say, the packaging material 14 need not necessarily be heat shrinkable, or shrunk about the article 12. Regardless, upon final assembly, the packaging material 14 defines an enclosed region 120 within which the article 12 is contained. A user (not shown) can easily transition the packaged good article 10 from the initial, unopened state of FIG. 1 to the opened state of FIG. 2 by simply grasping the tab 108 and pulling outwardly. In response to this action, the tearable tape system 16 tears a controlled opening 122 through the packaging material 14. In this regard, FIG. 2 illustrates a torn strand 124 as remaining partially secured to the packaging material 14. Alternatively, however, the packaged good article 10 can be configured such that the strand 124 is removed entirely, such as by forming a cut or nick at an opposite end (not shown) of the tearable tape system 16.

Figure 6:
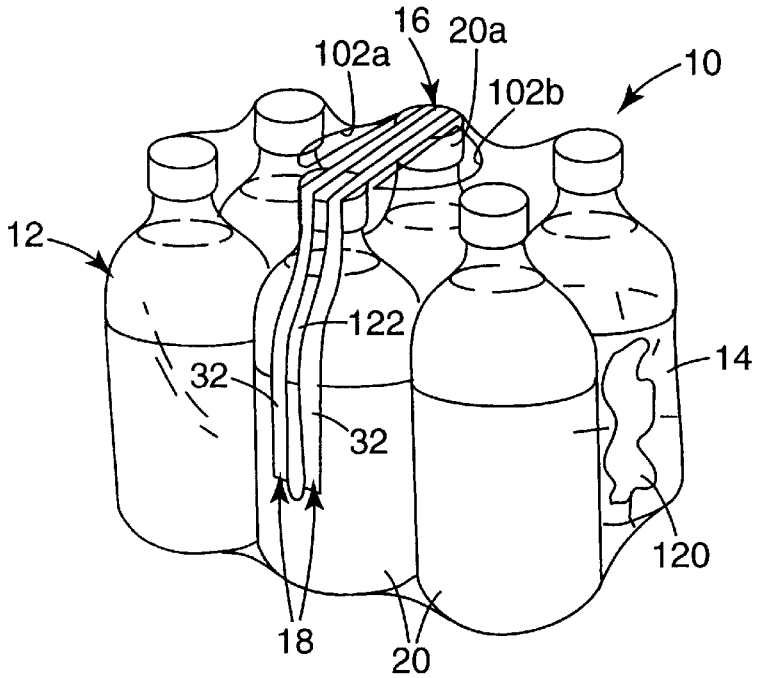
FIG. 6 is a perspective view of the packaged good article of FIG. 1, in an opened state, illustrating use thereof.

With reference to FIG. 6, the remaining sections 32 of the tearable tape system 16 reinforce the packaging material 14 along the opening 122. Thus, the packaging material 14 will not undesirably tear or otherwise deform. Further, with the one preferred embodiment in which the packaging material 14 is heat shrunk about the article 12, the second sections 32 of the tearable tape system 16 serve to substantially maintain a stretch or rigidity of the packaging material 14 about the article 12. As a result, a user (not shown) can expand a size of the opening 122 by simply pulling the second sections 32 away from one another to thereby gain access to the enclosed region 120. One or more of the products 20, such as the product 20*a,* is then easily removed from the enclosed region 120 via the opening 122. The reinforcing feature of the second sections 32 maintains a stretch of the packaging material about the remaining products 20, such that the remaining products 20 will not become dislodged or otherwise displaced. Where desired, the product 20*a,* or a separate product, can easily be returned to, and maintained within, the enclosed region 120 via the opening 122.

Figure 7:
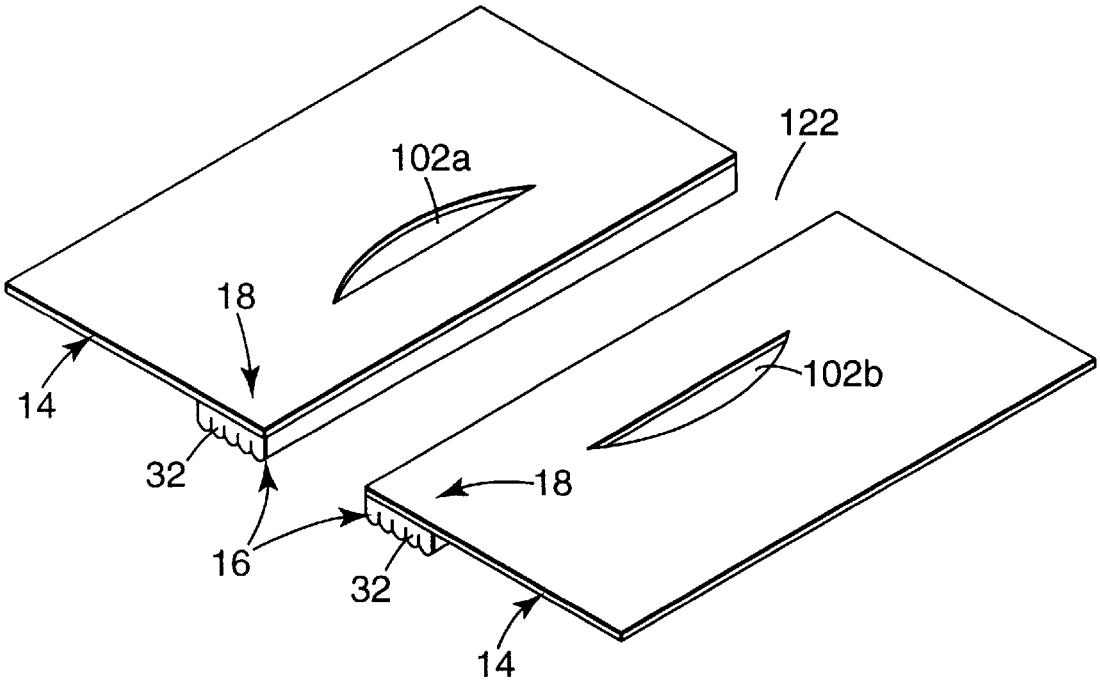
FIG. 7 is an enlarged, perspective view of a portion of the packaged good article of FIG. 1 in an opened state.

Regardless of whether one or more of the products 20 is removed from the enclosed region 120, the packaged good article 10 can easily be transported in the opened state. For example, FIG. 7 provides a simplified, perspective view of a portion of one preferred embodiment of the packaged good article 10 in the opened state. In particular, the tearable tape system 16 is comprised of the tearable tape strip 40 (previously described with reference to FIG. 3A) otherwise secured to the packaging material 14 (a thickness of which has been greatly exaggerated in FIG. 7 for purposes of illustration). With the one preferred embodiment, the packaging material 14 includes the slits 102*a,* 102*b.* In the opened state, the tearable tape system 16 has been transitioned to tear the opening 122 through the packaging material 14. As shown, the second sections 32 remain secured to the packaging material 14 in the opened state. Each of the second sections 32, in combination with the packaging material 14 otherwise secured thereto, is available as the handle 18. That is to say, a user (not shown) can extend his or her hand through the opening 122, around (or below) one of the second sections 32, and then outwardly through the respective slit 102*a* or 102*b.* Alternatively, the user can extend his or her hand through a first one of the slits (e.g., the slit 102*a*), around (or below) both of the second sections 32 and then outwardly through the outer slit (e.g., the slit 102*b*) such that the second sections 32 along with the associated packaging material 14, act in combination as the handle. Conversely, where the slits 102*a,* 102*b* are not provided, the user simply extends his or her hand through the opening 122 and around (or below) one of the second sections 32, with that second section 32 and the packaging material 14 combining to provide the handle 18. Thus, the handle 18 allows the user to grasp and lift the packaged good article 10 (FIG. 6). As previously described, the tearable tape system 16 is configured such that the second sections 32, in combination with the packaging material 14, exhibit sufficient strength to support a weight of the article 12 and not otherwise deform.

Figure 8:
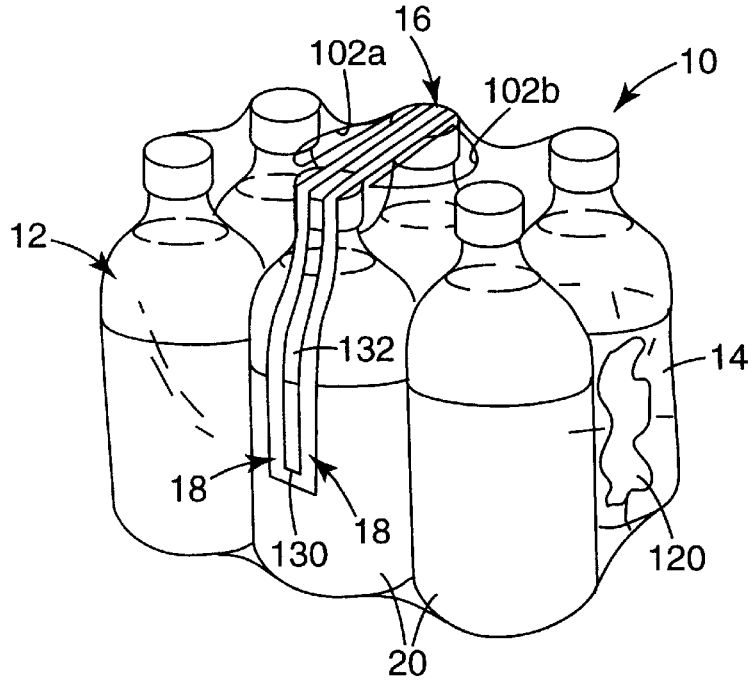
FIG. 8 is a perspective view of an alternative embodiment packaged good article in accordance with the present invention.

To enhance a strength of the packaged good article 10 in the opened state, the opening 122 can be defined so as to not extend beyond the tearable tape system 16. For example, FIG. 8 illustrates nicks or cuts 130, otherwise defining the tab 108, as being formed entirely within the tearable tape system 16 (as opposed to the nicks 50 shown in FIGS. 1, 2 and 6 that extend beyond the leading end 106). Although not shown, a similar cut(s) is formed adjacent a trailing end of the tearable tape system 16. With this alternative configuration, an opening 132 formed by a tearing operation is entirely circumscribed, and thus supported, by the tearable tape system 16. During a subsequent lifting operation, the lifting force is distributed along the tearable tape system 16 and not directly onto an otherwise cut or torn portion of the packaging material 14. As a result, the packaging material 14 is less likely to undesirably stretch or otherwise fail when the packaged good article 10 is lifted via the handle 18.

Figure 9:
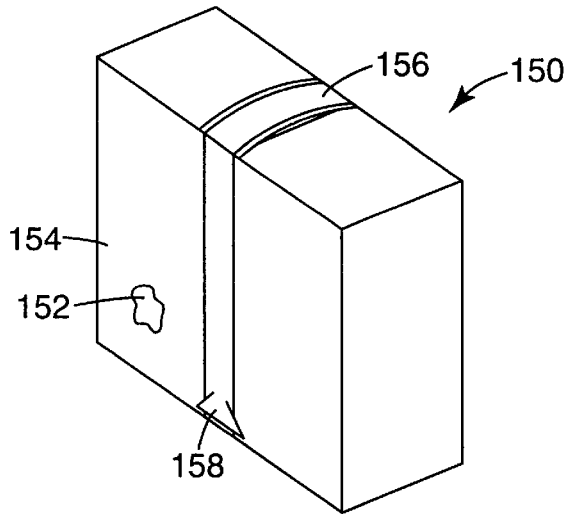
FIG. 9 is a perspective view of another alternative packaged good article in accordance with the present invention in an initial, closed state.

While the packaged good article 10 has been preferably described as utilizing a plastic film as the packaging material 14, other constructions are equally acceptable. For example, FIG. 9 depicts an alternative packaged good article 150 that includes an article 152, packaging material 154, and a tearable tape system 156. As a point of reference, the article 152 is shown in block form for ease of illustration. The packaging material 154 is a paperboard material enclosing the article 152. The tearable tape system 156 can assume any of the forms previously described (e.g., FIGS. 3A–3D), but is preferably similar to the tearable tape system 70 illustrated in FIG. 3C and includes a tearable tape strip on an exterior surface and a narrow-width tear strip on an interior surface of the packaging material 154.

Figure 10A:
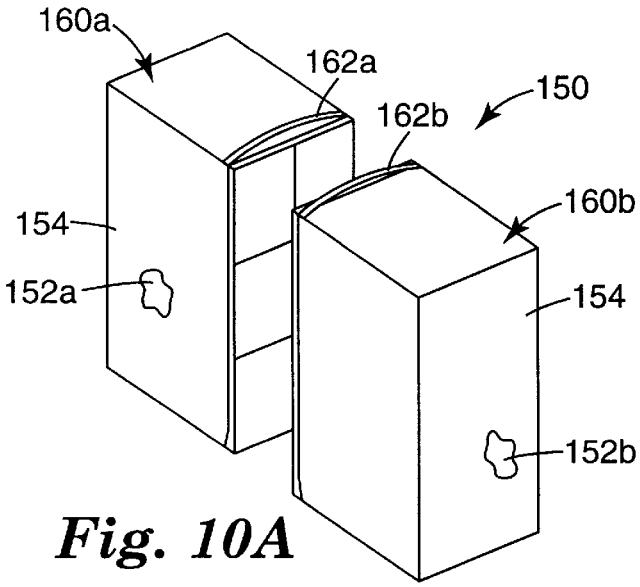
FIG. 10A is a perspective view of the packaged good article of FIG. 9 in a first opened state.

Following assembly, the tearable tape system 156 is available to tear an opening through the packaging material 154, such as by pulling on a tab 158 formed in the tearable tape system 156. As shown in FIG. 10A, following this tearing operation, the packaged good article 150 can be separated into two separate packs 160*a,* 160*b.* For example, the tearable tape system 156 can circumscribe an entirety of the packaging material 154 so as to entirely separate the packs 160*a,* 160*b.* Alternatively, because the packaging material 154 is paperboard, the user can simply force the packs 160*a,* 160*b* apart from one another. Regardless, each of the packs 160*a,* 160*b* is now open so that the articles 152*a,* 152*b* contained therein can be removed. Further, each of the packs 160*a,* 160*b* is provided with a separate handle 162*a,* 162*b* via the tearable tape system 156.

Figure 10B:
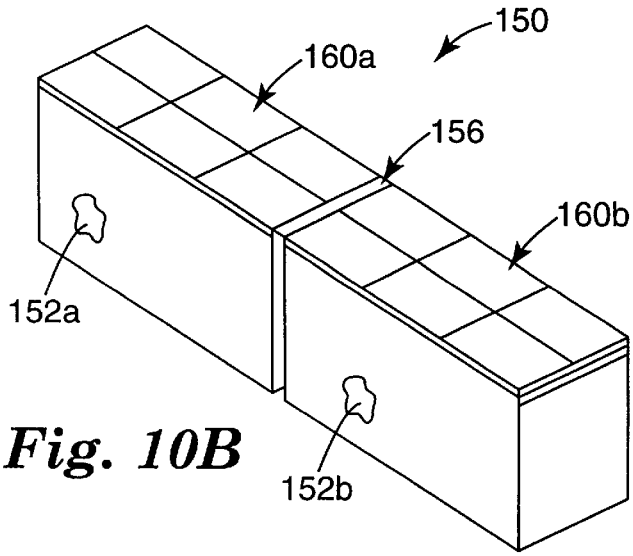
FIG. 10B is a perspective view of the packaged good article of FIG. 9 in a second opened state.

Alternatively, the tearable tape system 156 can be configured to encompass less than the entire perimeter of the packaged good article 150. As shown in FIG. 10B, following the tearing operation, the packs 160*a,* 160*b* can be unfolded relative to one another so as to access the contained articles 152*a,* 152*b.* Following use, the packs 160*a,* 160*b* can then be folded back toward one another, and the handles 162*a,* 162*b* (shown apart from one another in FIG. 9A) available for transporting the packaged good article 150.

The packaged good article and method of use thereof presents a marked improvement over previous designs. In particular, implementation of the disclosed tearable tape system not only promotes easy opening of the package, but also provides a strong, reinforced handle for subsequent transporting of the packaged good article in an opened state.

Although the present invention has been described with reference to preferred embodiments, workers skilled in the art will recognize that changes can be made in form and detail without departing from the spirit and scope of the present invention. For example, the various embodiments have illustrated a single elongated strip of the tearable tape system being applied to a single package. Alternatively, the packaged good article can include a plurality of spaced tearable tape systems.

What is claimed is:

1. A packaged good article comprising:

an article;

a packaging material formed about the article, wherein the packaging material is a plastic film, and wherein the film is shrink-wrapped about the article; and a tearable tape system secured to the packaging material, the tearable tape system including first and second sections, the first section being tearable relative to the second section;

wherein the tearable tape system is configured to be tearable from an initial, unopened state in which an area of the packaging material contacting the tearable tape system is intact, to an opened state in which the tearable tape system tears an opening through the packaging material for accessing the article, the second section remaining secured to the packaging material and, in combination with the packaging material, providing a handle for carrying the packaged good article in the opened state, the handle configured to have sufficient strength for supporting a weight of the article.

2. The packaged good article of claim 1, wherein the article includes a plurality of products.

3. The packaged good article of claim 2, wherein the plurality of products are separable from one another in the opened state.

4. The packaged good article of claim 1, wherein the packaging material is paperboard.

5. The packaged good article of claim 1, wherein the tearable tape system includes a first tearable tape strip secured to an interior surface of the packaging material.

6. The packaged good article of claim 5, wherein the first tearable tape strip is selected from the group consisting of reinforced strapping tape, tensilized polypropylene, and filament reinforced tape.

7. The packaged good article of claim 5, wherein the tearable tape strip is internally tearable.

8. The packaged good article of claim 5, wherein the tearable tape strip includes a longitudinal central section and opposing, longitudinal side sections, the central section being tearable relative to the side sections such that in the opened state, at least one of the side sections, in combination with the packaging material, provides the handle.

9. The packaged good article of claim 8, wherein the side sections form separate handles in the opened state.

10. The packaged good article of claim 8, wherein the side sections are configured to reinforce the packaging material about the opening in the opened state.

11. The packaged good article of claim 5, wherein the tearable tape system further includes a cover tape secured to an exterior surface of the packaging material opposite the first tearable tape strip.

12. The packaged good article of claim 5, wherein the tearable tape system further includes a second tearable tape strip secured to an exterior surface of the packaging material, at least a portion of the second tearable strip overlapping at least a portion of the first tearable tape strip.

13. The packaged good article of claim 1, wherein the tearable tape system includes a tearable tape strip secured to an exterior surface of the packaging material and a narrow-width tear strip secured to an interior surface of the packaging material substantially opposite the tearable tape strip, the narrow-width tear strip having a width less than a width of the tearable tape system such that an outward pulling force applied to the narrow-width tear strip tears a portion of the tearable tape strip away from a remainder thereof, the remaining portion of the tearable tape strip, in combination with the packaging material, providing the handle.

14. The packaged good article of claim 1, wherein the tearable tape system includes a narrow-width tear strip secured to an interior surface of the packaging material and a pair of guide strips secured to an exterior surface of the packaging material adjacent opposing sides of the narrow-width tear strip, respectively, the narrow-width tear strip being tearable relative to the guide strips such that at least one of the guide strips, in combination with the packaging material, provides the handle in the opened state.

15. The packaged good article of claim 1, wherein the packaging material is formed to define a machine direction, the tearable tape system extending substantially parallel to the machine direction.

16. The packaged good article of claim 1, wherein the packaging material is formed to define a machine direction, the tearable tape system extending substantially perpendicular to the machine direction.

17. The packaged good article of claim 1, wherein the tearable tape system and the packaging material are configured to form a handle in the unopened state.

18. The packaged good article of claim 1, wherein the packaging material apart from the handle is configured to support a weight of the article in response to a lifting force placed upon the handle.

19. A packaged good article comprising:

an article;

a packaging material formed about the article; and a tearable tape system secured to the packaging material, the tearable tape system including first and second sections, the first section being tearable relative to a the second section;

wherein the tearable tape system is configured to be tearable from an initial, unopened state in which an area of the packaging material contacting the tearable tape system is intact, to an opened state in which the tearable tape system tears an opening through the packaging material for accessing the article, wherein the opening is circumscribed by the tearable tape system in the opened state, the second section remaining secured to the packaging material and, in combination with the packaging material, providing a handle for carrying the packaged good article in the opened state, the handle configured to have sufficient strength for supporting a weight of the article.

20. The packaged good article of claim 19, wherein the article includes a plurality of products.

21. The packaged good article of claim 19, wherein the packaging material is a plastic film.

22. The packaged good article of claim 19, wherein the tearable tape system includes a first tearable tape strip secured to an interior surface of the packaging material.

23. The packaged good article of claim 22, wherein the tearable tape strip is internally tearable.

24. The packaged good article of claim 19, wherein the tearable tape system and the packaging material are configured to form a handle in the unopened state.

25. A packaged good article comprising:

an article;

a packaging material formed about the article;

a tearable tape system secured to the packaging material, the tearable tape system including first and second section, the first section being tearable relative to the second section;

wherein the tearable tape system is configured to be tearable from an initial, unopened state in which an area of the packaging material contacting the tearable tape system is intact, to an opened state in which the tearable tape system tears an opening through the packaging material for accessing the article, the second section remaining secured to the packaging material and, in combination with the packaging material, providing a handle for carrying the packaged good article in the opened state, the handle configured to have sufficient strength for supporting a weight of the article; and a first slit formed through the packaging material adjacent a side of the tearable tape system for facilitating grasping of the handle in the opened state.

26. The packaged good article of claim 25, further comprising a second slit formed through the packaging material adjacent a side of the tearable tape system opposite the first slit.

27. The packaged good article of claim 26, wherein the tearable tape system is configured to provide two of the second sections in the opened state, the handle being defined by the two second sections and the packaging material between the first and second slits.

28. The packaged good article of claim 25, wherein the article includes a plurality of products.

29. The packaged good article of claim 25, wherein the packaging material is a plastic film.

30. The packaged good article of claim 25, wherein the tearable tape system includes a first tearable tape strip secured to an interior surface of the packaging material.

31. The packaged good article of claim 30, wherein the tearable tape strip is internally tearable.

32. The packaged good article of claim 25, wherein the tearable tape system and the packaging material are configured to form a handle in the unopened state.

33. A method of packaging an article comprising a plurality of products in a packaging material, the method comprising:

providing a packaging material, wherein the packaging material includes a plastic film;

selecting a tearable tape system including a first section tearable relative to a second section, the second section having, in combination with the packaging material, a strength sufficient to support a weight of the article;

securing a length of the tearable tape system to a sheet of the packaging material; and forming the packaging material about the article, wherein forming the packaging material about the article includes: sealing the film about the article; and heating the sealed film to a temperature sufficient to shrink the film onto the article;

wherein the tearable tape system is transitionable to an opened state in which the tearable tape system tears an opening through the packaging material for accessing the article, the second section remaining secured to the packaging material in the opened state and providing a handle.

34. The method of claim 33, further including forming a first slit through the film adjacent the tearable system prior to heating the sealed film.

35. The method of claim 33, wherein the packaging material is paperboard.

36. The method of claim 33, wherein the tearable tape system is applied along a machine direction of the packaging material.

37. The method of claim 33, wherein the tearable tape system is applied perpendicular to a machine direction of the packaging material.

38. The method of claim 33, further comprising:

estimating a weight of the article, wherein the tearable tape system is selected based upon a weight of the article.

39. A method of packaging an article comprising a plurality of products in a packaging material, the method comprising:

providing a packaging material;

selecting a tearable tape system including a first section tearable relative to a second section, the second section having, in combination with the packaging material, a strength sufficient to support a weight of the article;

securing a length of the tearable tape system to a sheet of the packaging material;

forming the packaging material about the article;

wherein the tearable tape system is transitionable to an opened state in which the tearable tape system tears an opening through the packaging material for accessing the article, the second section remaining secured to the packaging material in the opened state and providing a handle; and imparting a plurality of nicks through at least the packaging material at a leading end of the tearable tape system to form a tab at which tearing of the first section relative to the second section is initialized, wherein the nicks are formed within an area defined by the tearable tape system such that the tab does not include packaging material not otherwise encompassed by the tearable tape system.

40. A method of using a packaged good article including an article contained within an enclosed region formed by a packaging material formed about the article and a tearable tape system secured to the packaging material, the tearable tape system including first and second sections, the first section being tearable relative to the second section, the method comprising:

tearing the tearable tape system to tear an opening through the packaging material, wherein the second section remains secured to the packaging material upon tearing of the tearable tape strip; and lifting the packaged good article after tearing the tearable tape system by grasping the second section, the second section, in combination with the packaging material, being configured to support a weight of the article.

41. The method of claim 40, wherein the article includes a plurality of products, the method further comprising:

removing a one of the plurality of products from the enclosed region through the opening.

42. The method of claim 41, wherein the packaging material is a shrink-wrapped plastic such that the packaging material is stretched about the article, and further wherein the tearable tape system substantially maintains a stretch of the packaging material following removal of the one product.

43. The method of claim 42, wherein removal of the one product creates a space in the enclosed region, the method further comprising inserting an object into the space through the opening.

44. The method of claim 40, wherein the tearable tape system includes a longitudinal central section and opposing, longitudinal side sections, and further wherein tearing the tearable tape system includes:

tearing the central section relative to the side sections to form the opening.

45. The method of claim 44, wherein the packaging material is plastic and the side sections remain secured to the packaging material following tearing of the tearable tape system, the method further comprising:

enlarging the opening to gain access to the article by pulling the side sections in opposite directions, wherein the side sections reinforce the packaging material along longitudinal edges of the opening such that the packaging material does not tear during the step of enlarging the opening.

46. The method of claim 45, wherein the tearable tape system is configured to reinforce an entire perimeter of the opening.

47. The method of claim 44, wherein lifting the packaged good article includes grasping at least one of the opposing side sections.

48. The method of claim 40, wherein the packaged good article includes a slit through the packaging material adjacent the second section, and further wherein lifting the packaged good article includes:

extending a user's fingers around the second section and through the slit.

* * * * *

UNITED STATES PATENT AND TRADEMARK OFFICE

CERTIFICATE OF CORRECTION

PATENT NO. : 6,513,657 B2
APPLICATION NO. : 09/843004
DATED : February 4, 2003
INVENTOR(S) : Sheehan, Richard L., Jr.

It is certified that error appears in the above-identified patent and that said Letters Patent is hereby corrected as shown below:

Column 11
Line 17, delete "," and insert in place thereof - -,--.

Column 12
Line 44, following "to" delete "a".

Column 13
Line 9, delete "section" and insert in place thereof - - sections - -.

Signed and Sealed this

Twenty-second Day of August, 2006

JON W. DUDAS
*Director of the United States Patent and Trademark Office*